US007178276B2

(12) United States Patent
Yagi

(10) Patent No.: US 7,178,276 B2
(45) Date of Patent: Feb. 20, 2007

(54) STEAM IRON

(75) Inventor: Toyohiko Yagi, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/305,035

(22) Filed: Dec. 19, 2005

(65) Prior Publication Data

US 2006/0130374 A1 Jun. 22, 2006

(30) Foreign Application Priority Data

Dec. 20, 2004 (JP) ..... 2004-367171
Dec. 20, 2004 (JP) ..... 2004-367172

(51) Int. Cl.
*D06F 75/38* (2006.01)
*D06F 75/00* (2006.01)

(52) U.S. Cl. ..... 38/93

(58) Field of Classification Search ..... 38/93, 38/77.83, 77.9, 88, 80, 81, 97
See application file for complete search history.

(56) References Cited

U.S. PATENT DOCUMENTS 222,849 A * 12/1879 Welch ..... 38/93
2,708,801 A * 5/1955 Voskresenski ..... 38/77.83
2,729,004 A * 1/1956 Carl ..... 38/93
2,906,043 A * 9/1959 Jepson et al. ..... 38/77.7
4,658,520 A * 4/1987 Henneberger et al. ..... 38/93
5,592,763 A * 1/1997 Hahnewald et al. ..... 38/77.9
5,799,422 A * 9/1998 Demuth et al. ..... 38/93
6,216,369 B1 * 4/2001 Wolf et al. ..... 39/93
6,820,359 B2 * 11/2004 Muljadi ..... 38/93

FOREIGN PATENT DOCUMENTS

JP 48-28073 8/1973

* cited by examiner

*Primary Examiner*—Ismael Izaguirre
(74) *Attorney, Agent, or Firm*—Bacon & Thomas, PLLC

(57) ABSTRACT

A steam iron includes a base provided with a vaporization chamber for generating steam, the vaporization chamber being heated by a heater; a water tank for storing therein water to be supplied to the vaporization chamber; and a soleplate having a plurality of steam holes and a multiplicity of depressions, the soleplate being provided on a bottom surface of the base and the steam holes being communicated with the vaporization chamber. At least a part of the steam holes is consecutively arranged in a line and, further, at least a part of the depressions is arranged in multiple lines along the steam holes consecutively arranged in the line.

14 Claims, 3 Drawing Sheets

STEAM IRON

FIELD OF THE INVENTION

The present invention relates to a steam iron for removing wrinkles in clothes or the like.

BACKGROUND OF THE INVENTION

Conventionally, such steam iron has a plurality of steam holes arranged in a line along an approximately U-shaped area on its soleplate (see, e.g., Japanese Utility Model Publication No. S48-28073).

The following is a mechanism of removing wrinkles by ironing clothes. Fibers of clothes are swelled by heat and moisture of steam ejected through the steam holes on the soleplate. Accordingly, transformed portions of the fibers, i.e., wrinkles in the clothes, are softened and then immediately dried along a plane of the soleplate by heat and surface pressure thereof, thereby removing the wrinkles. However, the conventional configuration has a drawback in that wrinkles in clothes cannot be effectively removed when clothes are not sufficiently steamed with the ejected steam.

SUMMARY OF THE INVENTION

It is, therefore, an object of the present invention to provide a steam iron capable of effectively removing wrinkles in clothes by sufficiently steaming clothes with ejected steam without increasing the amount of steam.

In accordance with the present invention, there is provided a steam iron including: a base provided with a vaporization chamber for generating steam, the vaporization chamber being heated by a heater; a water tank for storing therein water to be supplied to the vaporization chamber; and a soleplate having a plurality of steam holes and a multiplicity of depressions, the soleplate being provided on a bottom surface of the base and the steam holes being communicated with the vaporization chamber, wherein at least a part of the steam holes is consecutively arranged in a line and, further, at least a part of the depressions is arranged in multiple lines along the steam holes consecutively arranged in the line.

BRIEF DESCRIPTION OF THE DRAWINGS

The above and other objects and features of the present invention will become apparent from the following description of preferred embodiments, given in conjunction with the accompanying drawings, in which.

DETAILED DESCRIPTION OF THE PREFERRED EMBODIMENT

Hereinafter, preferred embodiments of the present invention will be described in detail with reference to the accompanying drawings. However, the present invention is not limited to the preferred embodiments.

(First Preferred Embodiment)

Figure 1:
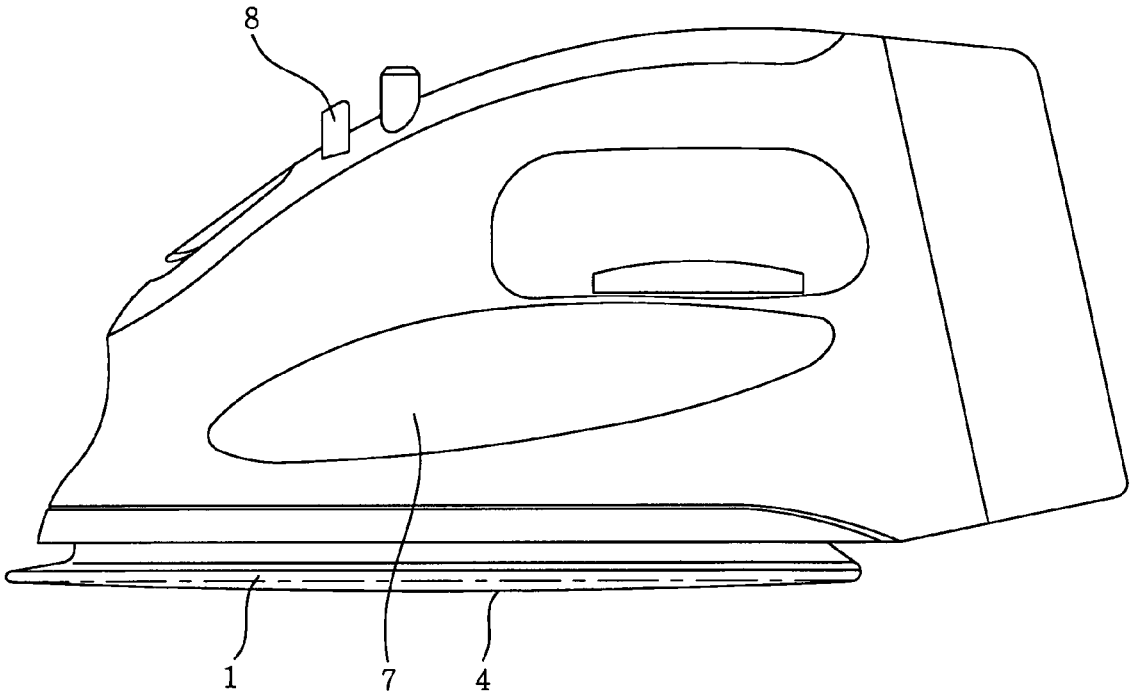
FIG. 1 shows a side view of a steam iron in accordance with a first preferred embodiment of the present invention.
Figure 2:
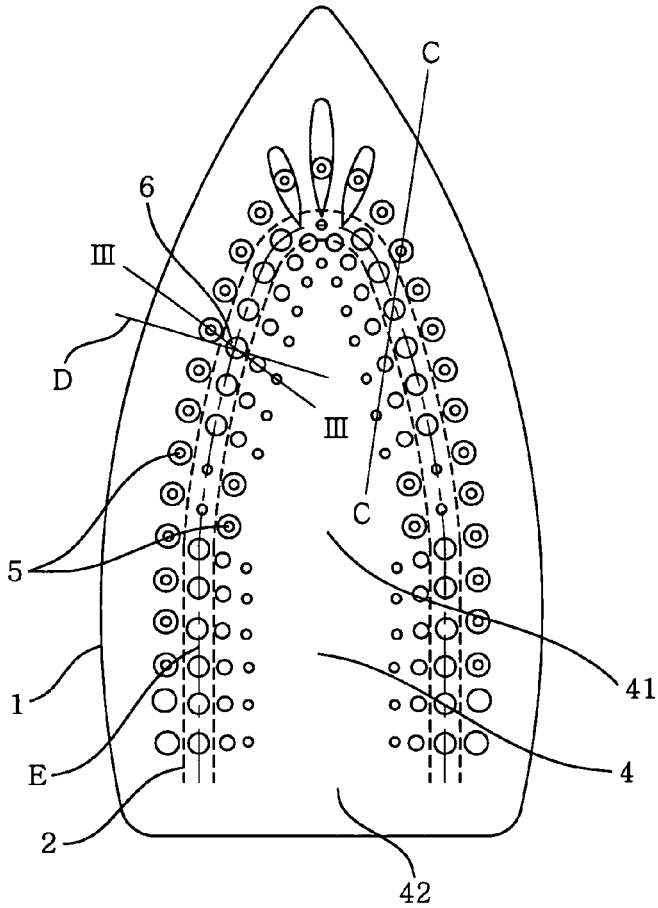
FIG. 2 describes a plan view of a soleplate of a base of the steam iron.
Figure 3:
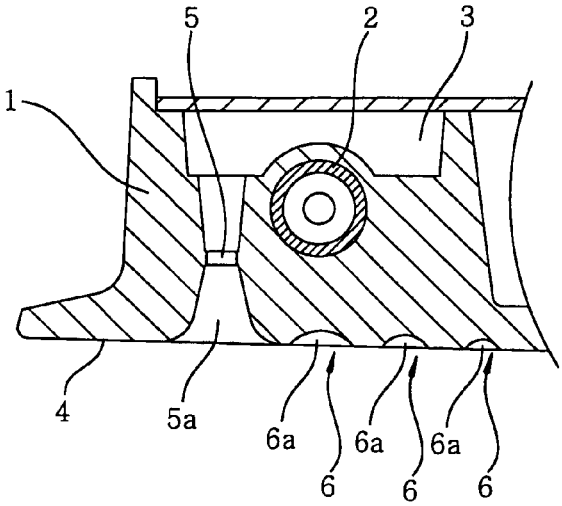
FIG. 3 provides a cross sectional view of the base of the steam iron in accordance with the first preferred embodiment, which is taken along line III—III of FIG. 2.
Figure 4:
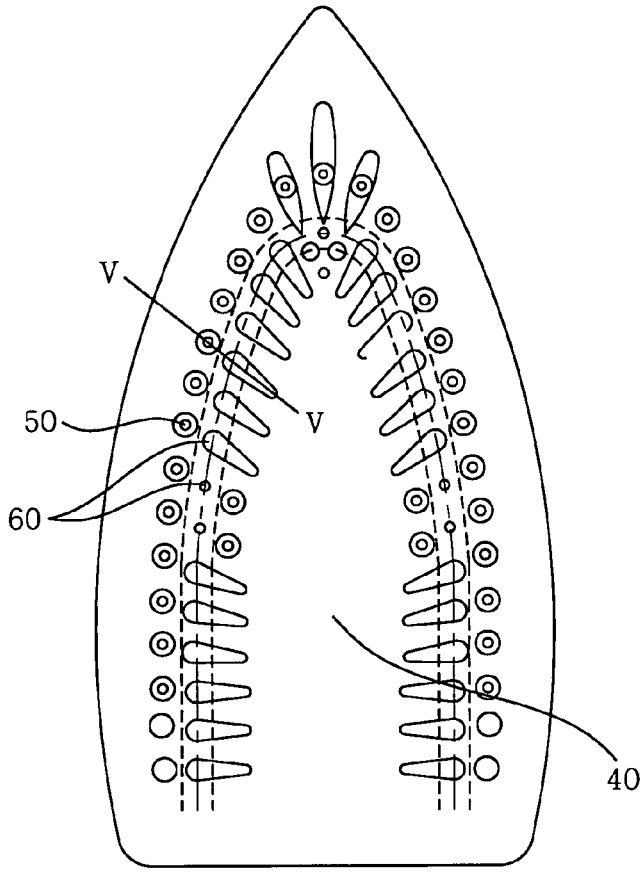
FIG. 4 represents a plan view of a soleplate of a base of a steam iron in accordance with a second preferred embodiment of the present invention.

FIG. 1 shows a side view of a steam iron in accordance with a first preferred embodiment of the present invention; FIG. 2 describes a plan view of a soleplate of a base of the steam iron; FIG. 3 provides a cross sectional view of the base of the steam iron in accordance with the first preferred embodiment, which is taken along line III—III of FIG. 2; FIG. 4 represents a plan view of a soleplate of a base of a steam iron in accordance with a second preferred embodiment of the present invention; and FIG. 5 offers a cross sectional view of the base of the steam iron in accordance with the second preferred embodiment, which is taken along line V—V of FIG. 4.

Referring to FIGS. 1 to 3, reference numeral 1 is a base heated by heater 2. Vaporization chamber 3 for generating steam is installed at an inner upper portion of the steam iron. As indicated by a dashed line in FIG. 2, approximately U-shaped heater 2 for heating base 1 to a temperature suitable for ironing is buried in base 1 with its both ends directed toward the rear portion of base 1.

Further, as shown in FIG. 2, soleplate 4 of base 1 is of a convex shape (approximately upside-down U-shape) that peaks at a central portion thereof. Provided at an approximately central portion of soleplate 4 is area 41 without having any steam holes or depressions. Further, area 42 without having any steam holes or depressions is provided at a rear end portion of the soleplate 4 extending by a predetermined distance from a rear end side of soleplate 4 in a forward direction.

In soleplate 4 of base 1, a plurality of steam holes 5 is consecutively provided in a line along an approximately U-shaped area corresponding to an outer side of heater 2, each of steam holes 5 communicating with vaporization chamber 3.

A plurality of depressions 6 is provided in an area at an inner side of the line of steam holes 5 consecutively arranged in a line along an approximately U-shaped area. Depressions 6 are arranged in multiple lines (in the first preferred embodiment, in three lines) along the line of steam holes 5. Moreover, as indicated by line III—III or C—C of FIG. 2, respective depressions 6 of the multiple lines are divided into groups, and depressions in each group are consecutively arranged to be approximately aligned with a straight line formed together with corresponding one of steam holes 5 provided at the outer portion thereof.

Further, for at least some of the approximately linear arrangements (along line III—III), the straight line mentioned above is backwardly inclined with respect to a line D drawn perpendicularly to heater 2 from a corresponding depression 6. Furthermore, as indicated by a line E, one line of depressions 6 arranged in the multiple lines is disposed right under heater 2.

Each of depressions 6 has a spherical surface, e.g., preferably of a substantially hemispherical shape, three-dimensionally and also approximately circular shape on the surface of soleplate 4. Depressions 6 are getting smaller and shallower as respective distances thereof from steam holes 5 increase.

Reference numeral 7 is a water tank for storing therein water to be supplied to vaporization chamber 3. Reference numeral 8 is a steam button for supplying water to vaporization chamber 3 or stopping the water supply thereto through an external manipulation.

Since other configurations are identical to those of the conventionally well-known steam iron, a detailed description thereof will be omitted.

Hereinafter, an operation of such configured steam iron will be described.

Since a basic operation of the steam iron is identical to that of the conventionally well-known one, a detailed description thereof will be omitted.

First of all, if water in water tank 7 is supplied to vaporization chamber 3 by manipulating steam button 8, steam is generated in vaporization chamber 3 and then outwardly ejected through steam holes 5 so that the item, e.g., clothes, is steamed while it being ironed.

At this time, the steam ejected through steam holes 5 is filled in spaces 5*a* inside steam holes 5 and in spaces 6*a* inside depressions 6 arranged in the multiple lines along steam holes 5. Thus, clothes can be continuously steamed and, then, fibers of the clothes can be sufficiently swelled before soleplate 4 passes therethrough.

As mentioned above, at least some depressions 6 in the multiple lines consecutively arranged to be approximately aligned with a straight line formed together with corresponding one of steam holes 5, the steam holes 5 being consecutively provided in the line, are backwardly inclined with respect to a line D drawn perpendicularly to heater 2 drawn from a corresponding depression 6. Accordingly, the steam ejected through the steam holes 5 can be sequentially applied to clothes with a basic ironing operation of sliding the iron in a forward direction.

Further, depressions 6 arranged in the multiple lines along steam holes 5 are getting smaller as their distances from steam holes 5 increase. Therefore, the respective amounts of steam in spaces 6*a* of depressions 6 are gradually reduced, thereby facilitating a quick drying process by soleplate 4 passing therethrough.

And also, depressions 6 become shallower, as their distances from steam holes 5 increase. Accordingly, irregularities of wrinkles passing through depressions 6 are getting sequentially gentler, thereby facilitating a smooth drying process by soleplate 4 passing therethrough.

Depressions 6 are not provided at central area 41 of soleplate 4. Thus, in case the iron is moved to slide in a forward direction for ironing, after clothes are swelled by steam ejected through steam holes 5 surrounding a right, a left and a front portion of central area 41 in a U-shape, a drying process of the clothes can be certainly carried out in central area 41 of soleplate 4.

Since soleplate 4 is of a convex shape that peaks at the central portion thereof, a resistance between the clothes and soleplate 4 becomes small, which ensures a smooth ironing. Further, the drying process of the clothes or removal of wrinkles can be securely achieved by locally increasing a surface pressure between the center portion of soleplate 4 and the clothes.

Since provided at the rear end portion of soleplate 4 is area 42 without having any steam holes or depressions, wherein the rear end portion extends by the predetermined distance from the rear end side of soleplate 4 in the forward direction, the drying process can be finally carried out by a basic ironing operation of sliding the iron in a forward direction.

Since the depressions are of substantially spherical surfaces, the depressions can be regularly applied to irregularities of the clothes regardless of a moving direction of the iron. Moreover, since the ironing is performed while the irregularities of clothes being slowly pressed by the depressions of the substantially spherical surfaces, the depressions do not cause new wrinkles and, further, peripheral portions or inner surfaces of the depressions do not inflict damages on fibers of the clothes.

As for a temperature distribution in soleplate 4, the temperature in a portion provided right under heater 2 is higher than those of other portions. Since, however, one line (line E) of depressions 6 arranged in the multiple lines is disposed almost right under heater 2 and the depressions do not make direct contacts with the clothes, thereby reducing the high temperature area making direct contact with the clothes, an approximately uniform temperature over an entire surface of soleplate 4 can be applied to the clothes.

Although a bottom surface of base 1 is set to be soleplate 4 in this embodiment, soleplate 4 can be separately formed and then provided on the bottom surface of base 1.

(Second Preferred Embodiment)

Figure 5:
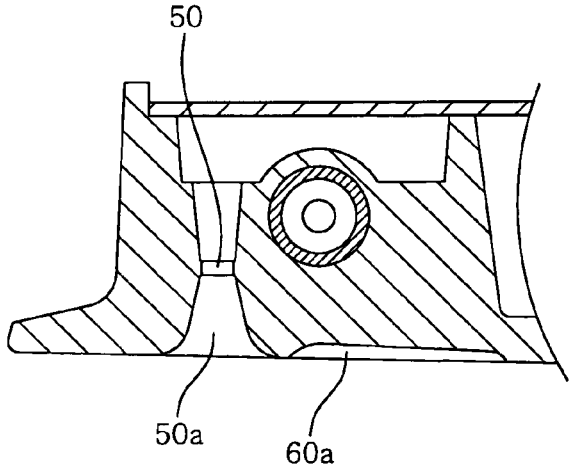
FIG. 5 offers a cross sectional view of the base of the steam iron in accordance with the second preferred embodiment, which is taken along line V—V of FIG. 4.

Hereinafter, a second preferred embodiment of the present invention will be described with reference to FIGS. 4 and 5. Depressions 60 become narrower and shallower, as their distances from steam holes 50 increase. Further, as indicated by line V—V of FIG. 4, each of steam holes 50 provided at outer side of depressions 60 is arranged such that it is positioned on a longitudinal center line of corresponding one of depressions 60. Other configurations are identical to those of the first preferred embodiment.

The steam ejected through steam holes 50 is filled in spaces 50*a* inside steam holes 50 and in spaces 60*a* inside depressions 60 arranged along steam holes 5. Thus, clothes can be continuously steamed and, then, fibers of the clothes can be sufficiently swelled before soleplate 40 passes therethrough. Further, since depressions 60 are getting narrower and shallower as their distances from steam holes 50 increase, respective amounts of steam in depressions 60 are gradually reduced. Accordingly, irregularities of wrinkles are getting sequentially gentler, thereby facilitating a smooth drying process with soleplate 40 passing therethrough.

Each of depressions 60 is formed as a single depression as if depressions 6 arranged in the multiple lines of the first preferred embodiment are combined together as one. In this case, a large amount of steam can be maintained compared to depressions 6 of the first preferred embodiment, so that fibers of clothes can be more effectively swelled.

As described above, the steam iron of the present invention can effectively remove wrinkles by sufficiently steaming clothes with ejected steam without increasing the amount of steam. The steam iron of the present invention can be widely applied to household and industrial steam irons.

While the invention has been shown and described with respect to the preferred embodiments, it will be understood by those skilled in the art that various changes and modification may be made without departing from the scope of the invention as defined in the following claims.

What is claimed is:

1. A steam iron comprising:

a base provided with a vaporization chamber for generating steam, the vaporization chamber being heated by a heater;

a water tank for storing therein water to be supplied to the vaporization chamber; and a soleplate having a plurality of steam holes and a multiplicity of depressions disposed separate from the steam holes, the soleplate being provided on a bottom surface of the base and the steam holes being communicated with the vaporization chamber, the soleplate being divided by a center line into two half portions;

wherein in one of the soleplate half portions, a plurality of the steam holes is consecutively arranged in a line and, further, plurality of the depressions is arranged in substantially parallel multiple lines along the steam holes consecutively arranged in the line.

2. The steam iron of claim 1, wherein at least a portion of the plurality of steam holes is consecutively arranged in the line along the heater.

3. The steam iron of claim 1 or 2, wherein the depressions arranged in the multiple lines along said at least a part of the steam holes are divided into groups, and depressions in each group and one of the steam holes are disposed in an approximately linear arrangement, and at least some of approximately linear arrangements for the groups are backwardly inclined with respect to a line drawn perpendicularly to the heater.

4. The steam iron of claim 1 or 2, wherein the depressions arranged in the multiple lines along said at least a part of the steam holes are getting smaller as their distances from corresponding one of the steam holes increase.

5. The steam iron of claim 1 or 2, wherein the depressions arranged in the multiple lines along said at least a part of the steam holes are getting shallower as their distances from corresponding one of the steam holes increase.

6. The steam iron of claim 1 or 2, wherein one line of the depressions arranged in the multiple lines is disposed almost right under the heater.

7. The steam iron of claim 1 or 2, wherein a central portion of the soleplate has an area without having any steam holes or depressions.

8. The steam iron of claim 7, wherein the soleplate has a downwardly convex shape that peaks at a central portion thereof.

9. The steam iron of claim 1 or 2, wherein a rear end portion of the soleplate is provided with an area without having any steam holes or depressions at a portion extending by a predetermined distance from a rear end side of the soleplate in a forward direction.

10. The steam iron of claim 1 or 2, wherein at least some of the depressions are of approximately circular shapes seen from a top.

11. The steam iron of claim 1 or 2, wherein at least some of the depressions are of substantially spherical surfaces.

12. A steam iron comprising:

a base provided with a vaporization chamber for generating steam, the vaporization chamber being heated by a heater;

a water tank for storing therein water to be supplied to the vaporization chamber; and a soleplate having a plurality of steam holes and a multiplicity of depressions disposed separate from the steam holes, the soleplate being provided on a bottom surface of the base and the steam holes being communicated with the vaporization chamber, wherein a plurality of the steam holes is consecutively arranged in a line and, further, a plurality of the depressions is arranged in a line along the steam holes consecutively arranged in the line, and wherein at least some of the depressions are getting gradually narrower as their distances from the steam holes increase.

13. A steam iron comprising:

a base provided with a vaporization chamber for generating steam, the vaporization chamber being heated by a heater;

a water tank for storing therein water to be supplied to the vaporization chamber; and a soleplate having a plurality of steam holes and a multiplicity of depressions disposed separate from the steam holes, the soleplate being provided on a bottom surface of the base and the steam holes being communicated with the vaporization chamber, wherein at least a part of the steam holes is consecutively arranged in a line and, further, at least a part of the depressions is arranged in a line along the steam holes consecutively arranged in the line, and wherein at least some of the depressions are getting gradually shallower as their distances from the steam holes increase.

14. The steam iron of claim 1 or 2, wherein a plurality of the steam holes is provided at an outer side of the heater.

* * * * *